US007919739B2

(12) United States Patent
Trouillot

(10) Patent No.: US 7,919,739 B2
(45) Date of Patent: Apr. 5, 2011

(54) ANTI-REBOUND LOCKING DEVICE FOR THE DEPLOYABLE FIN OF A PROJECTILE

(75) Inventor: Christian Trouillot, Morthomiers (FR)

(73) Assignee: Nexter Munitions, Versailles (FR)

( * ) Notice: Subject to any disclaimer, the term of this patent is extended or adjusted under 35 U.S.C. 154(b) by 1031 days.

(21) Appl. No.: 11/640,171

(22) Filed: Dec. 18, 2006

(65) Prior Publication Data

US 2007/0138335 A1 Jun. 21, 2007

(30) Foreign Application Priority Data

Dec. 19, 2005 (FR) ..... 05 13202

(51) Int. Cl.
*F42B 15/01* (2006.01)

(52) U.S. Cl. ..... 244/3.24

(58) Field of Classification Search ..... 244/3.24, 244/3.27, 3.28, 3.29
See application file for complete search history.

(56) References Cited

U.S. PATENT DOCUMENTS

| | | | | |
|---|---|---|---|---|
| 3,031,967 | A * | 5/1962 | Jasse | 244/3.29 |
| 3,598,345 | A * | 8/1971 | Suter | 244/3.27 |
| 4,709,878 | A * | 12/1987 | Titley | 244/3.28 |
| 4,728,058 | A * | 3/1988 | Brieseck et al. | 244/3.28 |
| 5,762,294 | A * | 6/1998 | Jimmerson | 244/49 |
| 6,739,548 | B1 * | 5/2004 | Bittle et al. | 244/3.29 |

FOREIGN PATENT DOCUMENTS

| | | |
|---|---|---|
| DE | 40 17 504 A1 | 7/1993 |
| FR | 1 536 271 A | 4/1969 |
| FR | 2 860 577 | 4/2005 |

* cited by examiner

*Primary Examiner* — Timothy D Collins
*Assistant Examiner* — Valentina Xavier
(74) *Attorney, Agent, or Firm* — Steptoe & Johnson LLP

(57) ABSTRACT

The invention relates to a locking device for a deployable surface or fin of a projectile characterized in that it incorporates at least one flexible tongue, one end of which protrudes in the groove, a recess to the side of the groove enabling the tongue to bend in a first direction to enable the fin to enter the groove.

7 Claims, 2 Drawing Sheets

ANTI-REBOUND LOCKING DEVICE FOR THE DEPLOYABLE FIN OF A PROJECTILE

BACKGROUND OF THE INVENTION

1. Field of the Invention

The technical scope of the invention is that of locking devices for the deployable surfaces of projectiles, such as wings, elevons or fins.

2. Description of the Related Art

It is classical to provide projectiles with stabilizing fins fired from a smooth-bore gun. During firing such fins lie along an external surface of the projectile or are inserted into radial housings. They deploy upon exiting the barrel to ensure their stabilizing function.

The stabilizing elements are generally sought to be deployed as quickly as possible to reduce the projectile's time of unstable flight, which is a source of dispersion with respect to the expected trajectory.

Patent FR-2860577 thus describes a deployment device for such fins.

Once deployed, the fins must occupy a reliable position and remain in this position. The absence of rebound is furthermore sought after since the existence of rebound delays the time at which the fins starts to become aerodynamically effective.

However, rapid deployment may well lead to the fin rebounding and there is, a priori, a certain contradiction between the requirement for the fins to be rapidly opened (a few milliseconds) and that of ensuring the reliable locking without rebound of the fins.

Moreover, the different positions of the fins constituting the tail piece cause aerodynamic imbalances which are both undesirable and impair flight accuracy.

Locking the fins is an essential function at the end of the opening phase. We note that, for the case of canards, failure to lock is catastrophic.

Different solutions to lock the fins have been imagined. Thus, FR-2860577 proposes an opening made in a block with respect to which the fin pivots, such opening receiving the end of a rod carrying the fin.

DE-19941557 and DE-19941555 describe bolts which cooperate with notches made in the fins.

The solutions associating bolts and notches are not satisfactory since there is always functional play remaining which enables angular movement of the fin with respect to its support. This results in movements or vibrations of the fins which impair firing accuracy. To this day, there are no satisfactory solutions to prevent rebounding.

SUMMARY OF THE INVENTION

The aim of the invention is to propose a simple reliable device which avoids rebounding of the fins and which also ensures their locking at the end of their moving into position.

Because of the principle of its functioning, the effectiveness and reliability of the device are all the greater in that the kinetic energy of the fin is high and in particular the opening speed.

The device, moreover, in no way hinders the deployment movement itself which ensures the final positioning of the fin and namely eliminates the risk (encountered with certain known devices) of stopping the fin before its deployment is fully completed.

Thus, the invention relates to a locking device for a deployable surface or fin of a projectile, such fin mounted able to pivot and being positioned in its deployed position in a radial groove in the projectile, such device wherein it incorporates at least one flexible tongue one end of which protrudes in the groove, a recess to the side of the groove enabling the tongue to bend in a first direction to enable the fin to enter the groove.

Advantageously, the width of the groove and the length of the tongue will be selected such that the tongue buts the fin up against one face of the groove.

The groove may be made in a support, the tongue being held by a block partially delimiting the side recess, the tongue being pinched between block and support.

The tongue may be constituted by sheet steel.

The bottom of the groove may include shock-absorbing material.

The support may comprise at least two elements arranged on either side of the groove, one of the two elements being made of a plastic material and incorporating an extension constituting the bottom of the groove.

BRIEF DESCRIPTION OF THE DRAWINGS

The invention will become more apparent from the following description of a particular embodiment, such description made with reference to the appended drawings, in which.

DETAILED DESCRIPTION OF PREFERRED EMBODIMENTS

Figure 1:
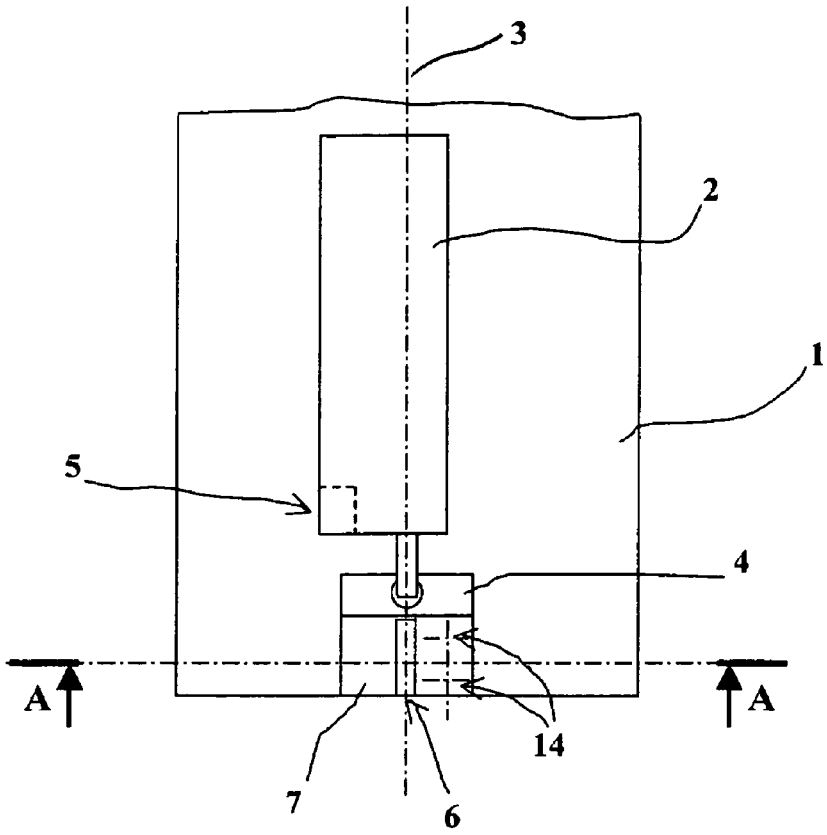
FIG. 1 schematically shows the rear part of a projectile equipped with the device according to the invention.

With reference to FIG. 1, a projectile 1 incorporates several deployable fins 2 at its rear part, only one of which is shown here.

The fin is in the folded position, pressing against and along the projectile body 1 and oriented substantially along axis 3 of the projectile. During firing, it pivots, thanks to a deployment mechanism 4, which is not described further here since it is not the subject of the present invention.

This deployment mechanism may be analogous to that described in patent FR-2860577 to which reference may be made for further details.

When the fin is deployed, a rear part 5 of the fin penetrates into a radial groove 6 arranged on a support 7 integral with the projectile body 1.

Figure 2:
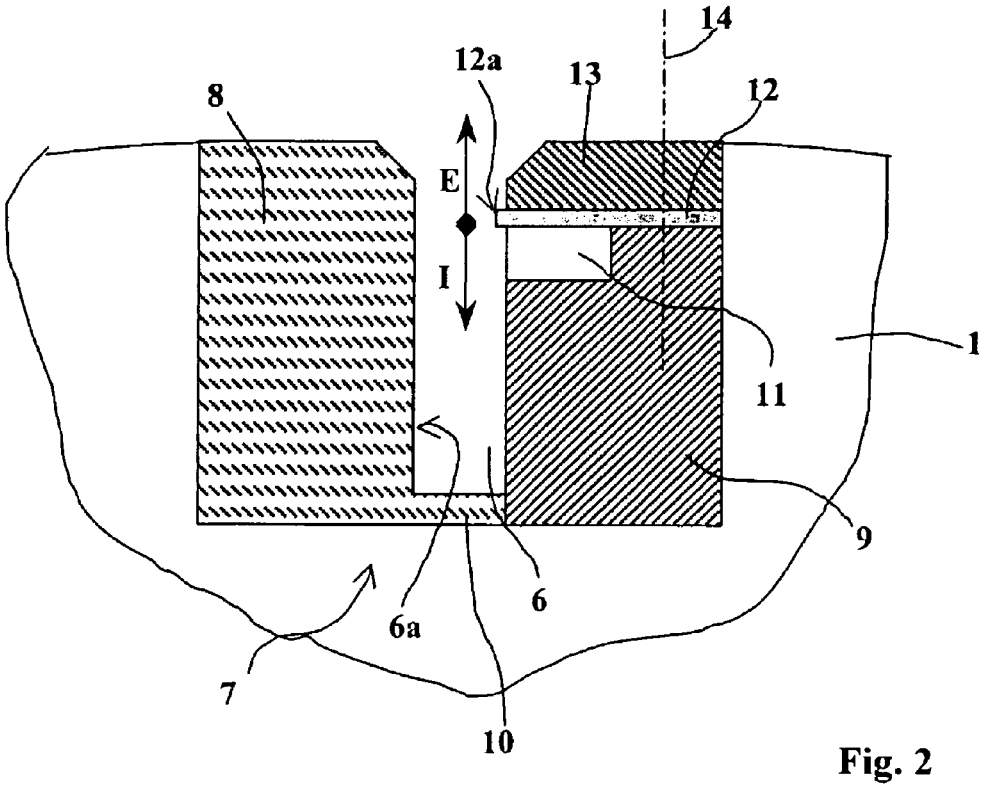
FIG. 2 is a cross section, along plane AA marked in FIG. 1, of a device according to the invention before the fin is deployed.

The support 7 may be more clearly seen in FIG. 2.

The support 7 comprises two elements 8 and 9 which are arranged on either side of the groove 6. These elements will be made integral with the projectile body 1, for example by screws (not shown).

One of these two elements (element 8) is made of a plastic material and incorporates an extension 10 which constitutes the bottom of the groove 6.

Thus, when the fin 2 is deployed, the shock of the fin against the bottom of the groove 6 is absorbed.

Element 9 is made of metal (for example aluminum). It has a recess 11 in its upper part.

In accordance with the invention, a tongue 12 is fastened to element 9. This tongue is constituted, for example, by a sheet of steel a few tens of millimeters thick with square edges. The tongue 12 is pinched between element 9 and a block 13 made, for example, of aluminum.

Fastening is ensured, for example, by two screws, only the axes 14 of which are shown in the Figures. In this way, the link between the tongue 12, element 9 and the block 13 can be assimilated to an embedding allowing neither slippage nor pivoting of the tongue 12.

Because of its material and its thickness, the tongue 12 has certain flexibility. It can bend upon the passage of the fin in the direction of the opening without opposing any resistance whilst still remaining within the range of elastic deformation.

It is arranged such that its end 12*a* protrudes into the groove 6. This part of the tongue has square edges so as to avoid any subsequent relative slippage with the fin 2 when this tends to rise up out of the groove 6. The tongue 12 thus protrudes by around 0.5 mm inside the groove 6.

The recess 11, to the side of the groove 6, enables the tongue 12 to bend in direction I thereby enabling the butting of the mechanism, thus preventing the fin from rising up in a direction E opposite to the first direction I.

Figure 3:
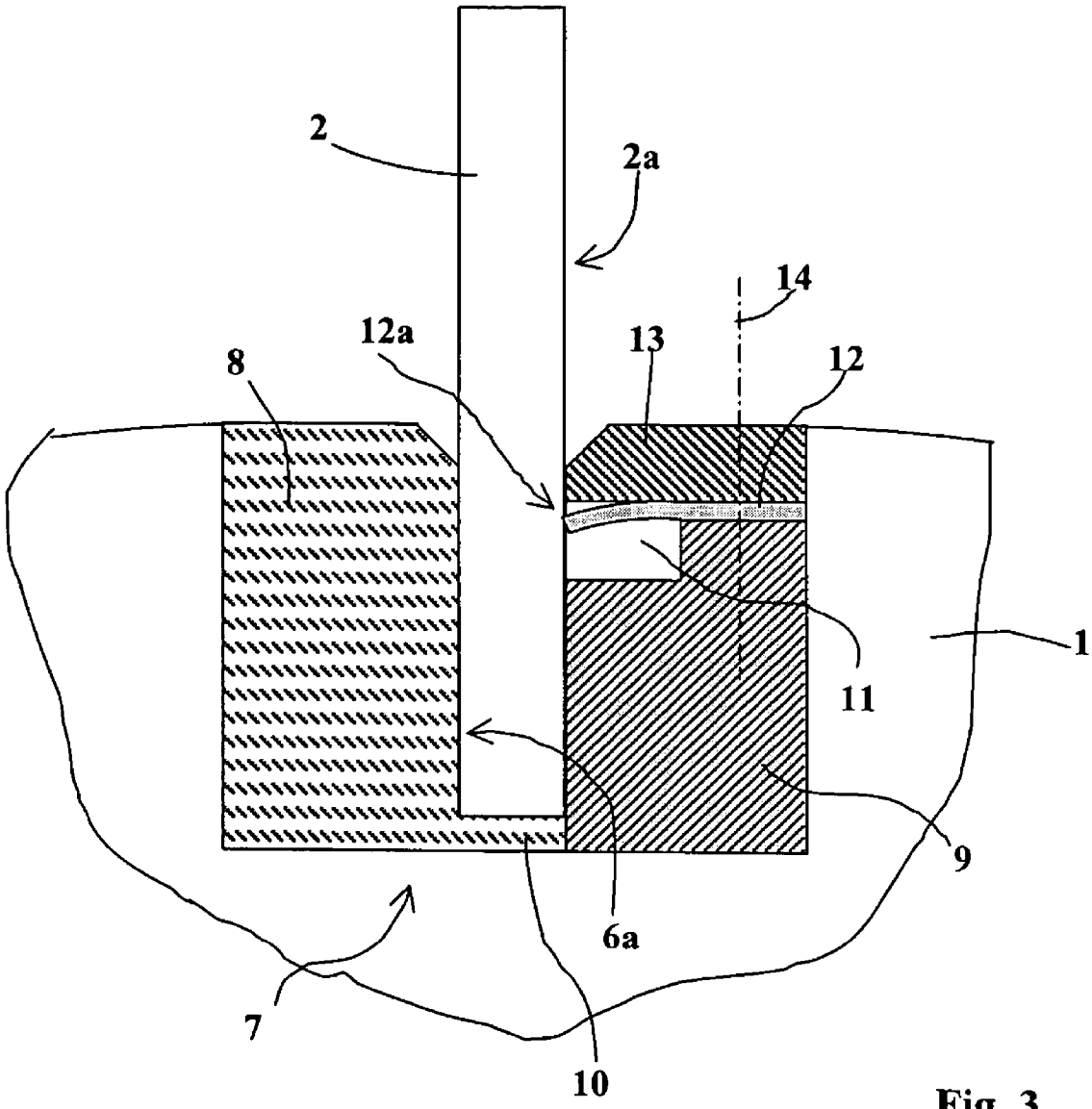
FIG. 3 shows this same device, with the fin locked.

FIG. 3 shows the fin 2 engaged in the groove 6.

When it enters the groove 6, the fin 2 pushes the tongue 12 with no difficulty causing it to bend easily and freely deform in the recess 11, allowing the fin 2 to pass.

Once in place, it is no longer possible to remove the fin 2 from the groove 6. Indeed, the end 12*a* of the tongue 12 presses on the lateral surface 2*a* of the fin without slippage, thanks to the square edges and to the judicious dimensions of the tongue.

By reaction, the tongue 12 presses the fin 2 onto the face 6*a* of the groove (integral with element 8). Indeed, the tongue works in compression under the action of the stresses communicated by the fin attempting to exit the groove.

The adherence stress of the fin 2 on the face 6*a* is greater than the external forces tending to raise the fin. The fin 2 is thus firmly immobilized by the adherence force at face 6*a*, and following the principle of buttressing. The device is all the more effective in that the external forces are substantial.

It is thus impossible for the fin to rebound, any backward movement being prevented by the tongue 12. The fin 2 is immobilized immediately, reliably and with no play, and the fin is no longer able to exit its groove. Additionally, by way of a variant, it is possible for a shock absorbing material (for example a layer of rubber) to be positioned in the bottom of the groove 6.

Additionally, elements 8 and 9 of the support 7 may be made of the same material. These elements may be constituted of a single piece 7.

The case of the deployment of stabilizing fins has been taken here as an example to describe the invention. It is naturally possible for the invention to be applied to other types of deployable surface (elevons, wing, etc).

It is moreover possible to implement the invention using a deployment device of a different structure to that described in patent FR-2860577.

What is claimed is:

1. A locking device for a deployable fin pivotably mounted on a projectile, said fin positionable in its deployed position in a radial groove which groove is in, and aligned parallel to the longitudinal axis of said projectile, said device including at least one flexible tongue, one end of which tongue protrudes into said groove, a recess in the side of said groove enabling said tongue to bend in a first direction to permit said fin to enter said groove.

2. The locking device according to claim 1, wherein the width of said groove and the length of said tongue are such that said tongue biases said fin against one face of said groove.

3. The locking device according to claim 1, wherein said groove is in a support, said tongue is held by a block partially defining said recess, and said tongue is held between said block and said support.

4. The locking device according to claim 1, wherein said tongue is sheet steel.

5. The locking device according to claim 2, wherein the bottom of said groove includes shock-absorbing material.

6. The locking device according to claim 3, wherein said support comprises at least two elements defining said groove there between, one of said two elements comprising a plastic material and having an extension constituting the bottom of said groove.

7. The locking device according to claim 4, wherein the bottom of said groove includes shock-absorbing material.

* * * * *